US007766286B2

(12) United States Patent
Kaczmarek et al.

(10) Patent No.: US 7,766,286 B2
(45) Date of Patent: Aug. 3, 2010

(54) HOLDER FOR A HEAT EXCHANGER

(75) Inventors: Fabrice Kaczmarek, Saverne (FR); Jean-Claude Meyer, Wiesviller (FR); Patrick Jung, Roth (FR)

(73) Assignees: Behr France Hambach S.A.R.L., Hambach (FR); Araymond et Cie., Grenoble (FR)

( * ) Notice: Subject to any disclaimer, the term of this patent is extended or adjusted under 35 U.S.C. 154(b) by 756 days.

(21) Appl. No.: 10/542,346

(22) PCT Filed: Nov. 14, 2003

(86) PCT No.: PCT/EP03/12765

§ 371 (c)(1),
(2), (4) Date: Jul. 14, 2005

(87) PCT Pub. No.: WO2004/065880

PCT Pub. Date: Aug. 5, 2004

(65) Prior Publication Data

US 2006/0053598 A1 Mar. 16, 2006

(30) Foreign Application Priority Data

Jan. 17, 2003 (EP) ..... 03290129

(51) Int. Cl.
*F16L 3/00* (2006.01)

(52) U.S. Cl. ..... 248/74.4; 248/316.1; 24/457

(58) Field of Classification Search ..... 248/65, 248/73, 74.1, 74.2, 316.1, 316.5, 316.7, 74.4; 24/489, 499, 500, 502, 504, 509, 457, 458, 24/522, 557

See application file for complete search history.

(56) References Cited

U.S. PATENT DOCUMENTS

| | | | | |
|---|---|---|---|---|
| 2,904,294 | A * | 9/1959 | Marygold | 248/74.4 |
| 2,931,607 | A * | 4/1960 | McFarland | 248/74.1 |
| 3,188,030 | A * | 6/1965 | Fischer | 248/68.1 |
| 4,244,083 | A * | 1/1981 | Aremka et al. | 24/16 R |
| 5,150,865 | A * | 9/1992 | Miller | 248/71 |
| 5,537,839 | A | 7/1996 | Burk et al. | |
| 5,601,262 | A * | 2/1997 | Wright | 248/74.4 |
| 5,704,418 | A | 1/1998 | Baader et al. | |
| 6,126,122 | A * | 10/2000 | Ismert | 248/74.1 |
| 6,315,034 | B1 | 11/2001 | Mahe et al. | |
| 6,405,788 | B1 | 6/2002 | Balthazard | |
| 6,463,631 | B2 * | 10/2002 | Noda | 24/16 R |
| 6,516,498 | B2 * | 2/2003 | LaCoy et al. | 24/16 R |
| 6,719,255 | B2 * | 4/2004 | Chen | 248/323 |
| 7,383,692 | B2 | 6/2008 | De Gelis | |

FOREIGN PATENT DOCUMENTS

| | | |
|---|---|---|
| DE | 42 38 853 A1 | 5/1994 |
| EP | 0 401 590 B1 | 12/1990 |
| FR | 2 614 688 A1 | 11/1988 |
| JP | 11-132208 A | 5/1999 |

* cited by examiner

*Primary Examiner*—J. Allen Shriver, II
*Assistant Examiner*—Steven M. Marsh
(74) *Attorney, Agent, or Firm*—Foley & Lardner LLP

(57) ABSTRACT

The invention relates to a holder for fixing additional parts to a fin-tube block (19) of a heat exchanger and/or for supporting the heat exchanger, said fin-tube block (19) comprising parallel front surfaces (19*a*, 19*b*) and lateral surfaces or lateral parts (21). According to the invention, the holder is embodied as a clip connection consisting of two lockable plastic clip elements (1, 10) which receive the fin-tube block (19) thereinbetween.

8 Claims, 3 Drawing Sheets

Figure 3:
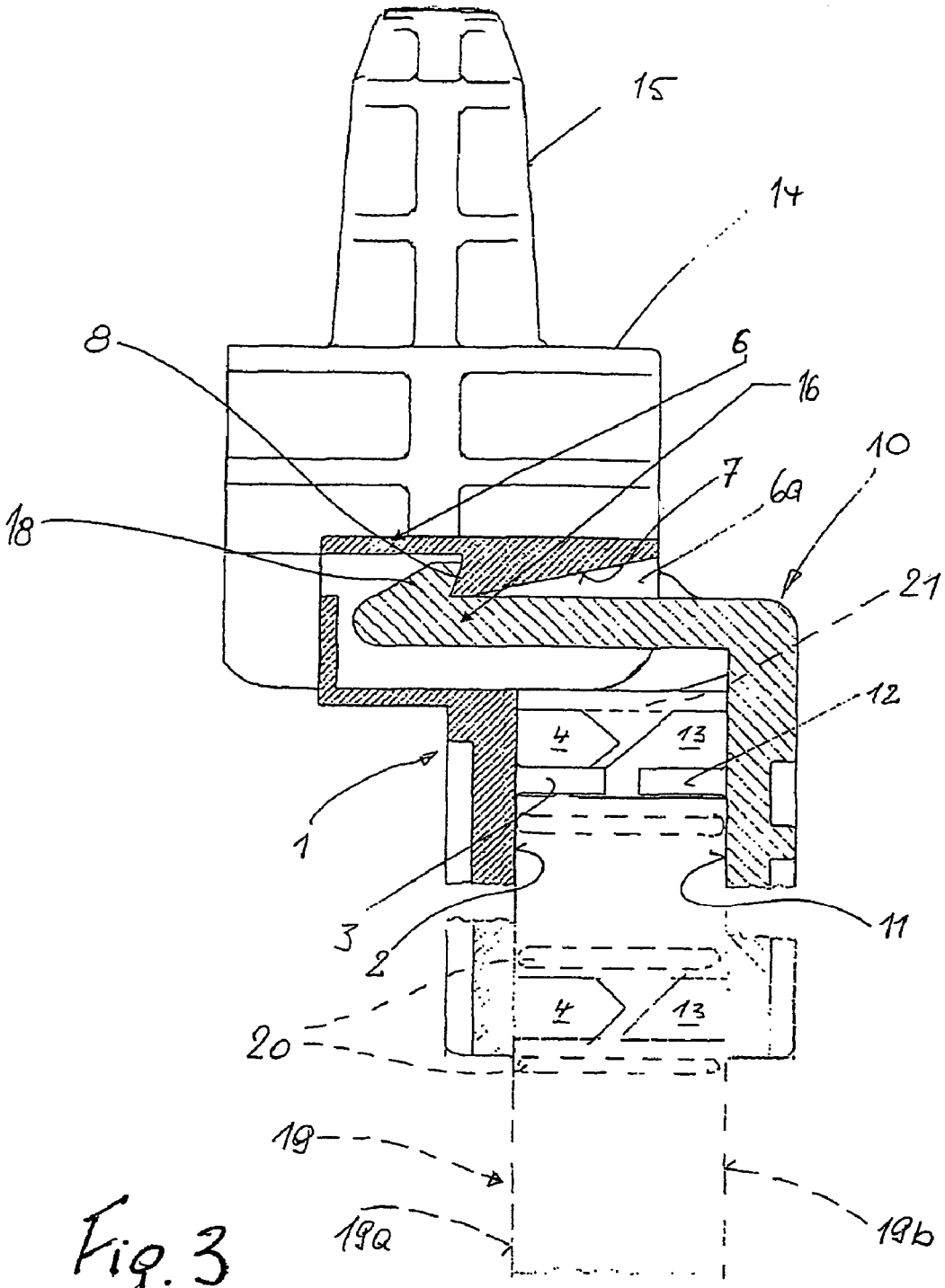

Fig. 1
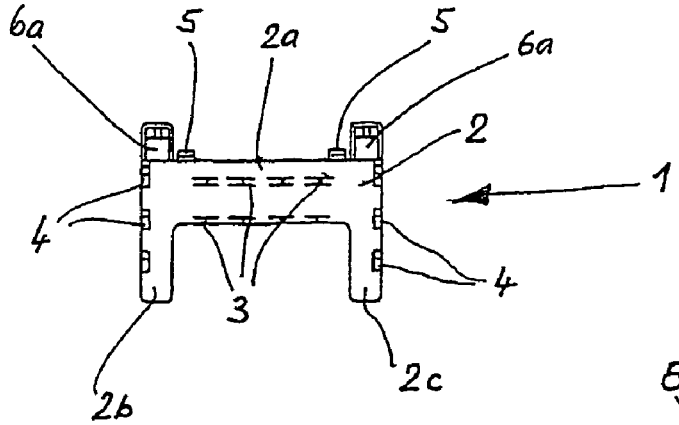
Fig. 1a
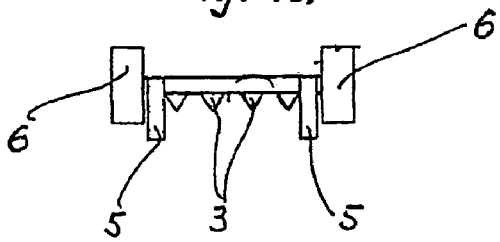
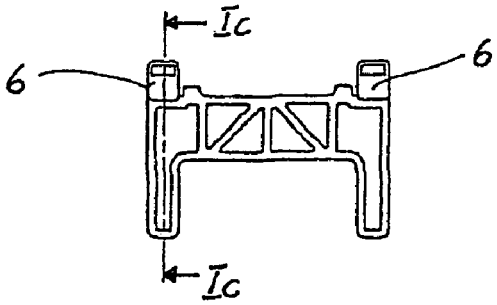
Fig. 1b
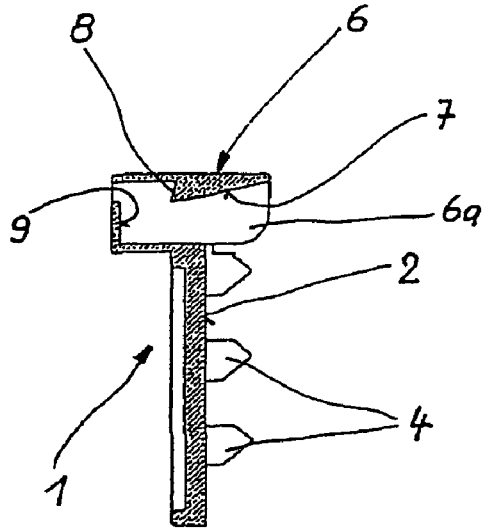
Fig. 1c

Fig.2a
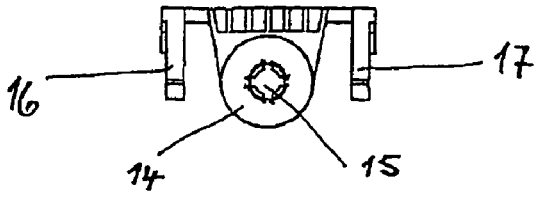
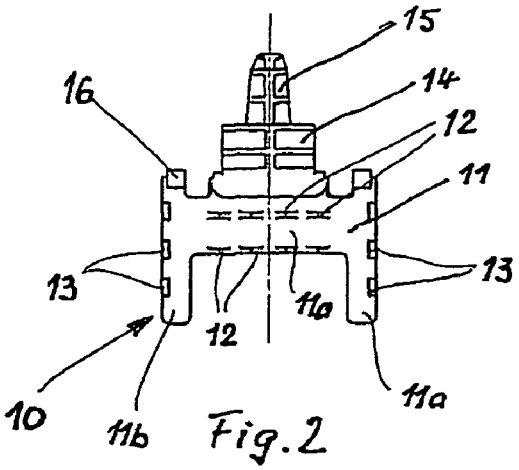
Fig.2
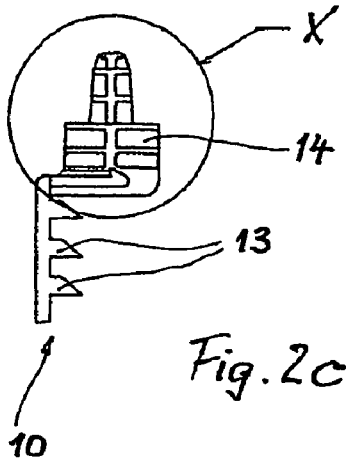
Fig.2c
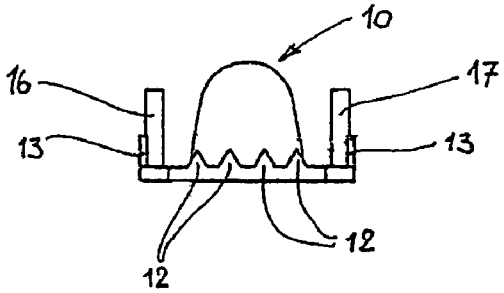
Fig. 2b
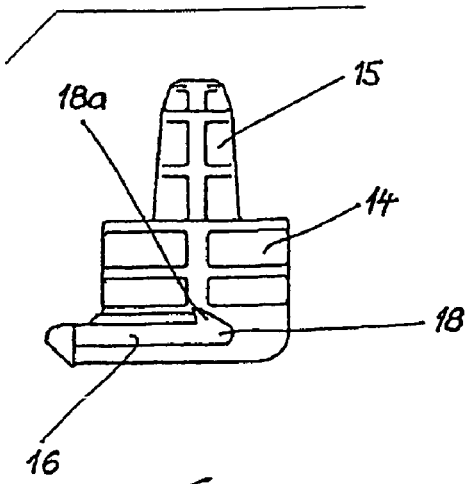
Fig. 2d

HOLDER FOR A HEAT EXCHANGER

The invention relates to a holder for attaching additional parts to a pipe/rib block of a heat exchanger and/or for supporting the heat exchanger, as claimed in the preamble of patent claim 1.

Known heat exchangers, for example according to DE-A 42 38 853, are composed of a pipe/rib block, i.e. flat pipes with corrugated ribs which are arranged between them. The ends of the flat pipes open into collecting pipes which are arranged on each side of the pipe/rib block and are soldered to the pipe/rib block. This heat exchanger, for example a condenser, must be mounted in the motor vehicle, being attached either to the frame of the vehicle or to another heat exchanger, for example a coolant radiator. As is known from DE-A 196 45 502, the attachment is carried out by means of metallic securing clamps which are screwed or riveted to the pipe/rib block. Such securing elements are used both to attach the heat exchanger itself and to attach additional parts, for example coolant connecting pipes for a condenser. The known mechanical holders require a plurality of parts such as holders, screws or rivets and take a relatively long time to mount.

The object of the present invention is to improve a holder of the type mentioned at the beginning with respect to the number of individual parts, the mounting time and also in terms of the manufacturing costs.

The means of achieving this object are the features of patent claim 1. According to the invention, the holder is embodied as a clip connection of two parts which are preferably manufactured from plastic and which are pressed against the pipe/rib block from both sides and latched to one another. As a result the two halves are permanently connected to the heat exchanger block like brackets and can thus perform the function of supporting the heat exchanger and/or the function of attaching additional parts. For these various functions, the holder is provided with correspondingly adapted supporting and attachment elements. The latching of the two parts provides the advantage that it is possible to dispense with screws or rivets. Since the two halves of the holder are injection molded from plastic or metal, the manufacturing costs are low. Furthermore, they are easy and quick to mount since both parts are positioned only at the anticipated location of the heat exchanger block and clipped together.

Advantageous refinements of the invention emerge from the subclaims. The two clamping elements are of different design: one has latching arms which engage over the side face of the pipe/rib block and the other has holding pockets into which the latching arms are inserted and latched there. The latching arms are advantageously embodied as sprung tongues which clip automatically into place when the holder is mounted and lock the two clamping elements to one another. The holding pockets advantageously have ramps and guide faces for introducing the tongues, i.e. a hollow profile, into which the tongues can easily he introduced during the mounting process. After the clamping elements have been pressed in, the latching projections arranged at the end of the tongues clip into place automatically behind a latching face in the holding pocket—thus ending the process of mounting the holder.

In a further advantageous refinement of the invention, rows of zigzag-shaped holding elements which extend perpendicularly and transversely are provided on the pressing faces, i.e. formed integrally on the clamping elements by injection molding. These prongs which are pointed or end in a wedge dig into the end faces of the pipe/rib block, i.e. in the ribs between the pipes when the clamping elements are pressed in, said prongs thus forming a positively locking connection between the holder and pipe/rib block. The holder can thus no longer slip on the block but instead maintains its position. The distance between the prongs is selected such that in each case they engage in the ribs between two pipes and engage entirely on the outside between the side part and the outermost pipe.

In a further advantageous refinement of the invention, the holder, i.e. one of its two clamping elements, has attachment and/or supporting means, either for supporting the heat exchanger with respect to the vehicle or attaching additional parts to the heat exchanger. These attachment means are adapted to the corresponding functions and may be embodied, for example, as pipe holders for securing feed lines and discharge lines for the coolant. In an advantageous refinement, a supporting means is embodied as a holding pin onto which, for example, a connecting flange can be plugged or which can be plugged into a corresponding bearing element, for example in the form of a rubber bushing, in order to support the heat exchanger with respect to the vehicle. Of course, a plurality of such holders may be mounted at any desired location along the side parts.

Exemplary embodiments of the invention are illustrated in the drawing and are described in more detail in the text which follows. In the drawing:

FIG. 1 shows half (first clamping element) of the holder according to the invention, FIG. 1*a* shows a plan view of the clamping element, FIG. 1*b* shows a view of the clamping element from behind, FIG. 1*c* shows a section along the line Ic-Ic in FIG. 1*b*, FIG. 2 shows the second half (second clamping element) of the holder according to the invention in a view from the front, FIG. 2*a* shows a view from above, FIG. 2*b* shows a view from below, FIG. 2*c* shows a view from the side, FIG. 2*d* shows a detail X from FIG. 2*c* and FIG. 3 shows a section through the holder with the pipe/rib block.

FIG. 1 shows half of a two-component holder, i.e. a first clamping element 1 in a view from the front, i.e. of a pressing face 2 which is composed of a rectangular face 2*a* and two protruding limbs 2*b*, 2*c*. On the one hand two rows of prongs 3 which are of triangular design and on the other hand two rows of further holding elements 4 which are embodied approximately in the shape of a wedge and run perpendicularly protrude from the pressing face 2.

FIG. 1*a* shows the triangular shapes of the holding elements 3 clearly. In addition, two stop bars 5 are arranged on the upper edge of the rectangular face 2*a* (cf. FIG. 1) and protrude in the direction of the prongs 3. In addition, two holding pockets 6 are arranged to the side of and also above the rectangular face 2*a*, and their function will be explained below.

FIG. 1*b* shows the first clamping element 1 from its rear on which ribbing for reinforcing the pressing face 2 can be seen.

FIG. 1*c* shows a section along the line Ic-Ic in FIG. 1*b*, i.e. through one of the two holding pockets 6. The holding pocket 6 is of hollow design and has an approximately box-shaped cross section which is open on its end side 6*a* which is on the right in the drawing. A ramp 7, i.e. an obliquely extending face which is continuous with a latching face 8 which is bent at an acute angle, extends from the end-face opening 6*a*. A stop face 9 is provided on the side lying opposite the end face 6*a*. The holding pocket 6 is integrally connected to the pressing plate or pressing face 2 from which the holding elements 4 which end in a wedge protrude. The clamping element 1 is manufactured as a single-piece plastic injection molded part.

FIG. 2 shows a second clamping element 10 in a view from the front, i.e. with a view of a pressing face 11 which is composed, in a way which is analogous to the first clamping element 1, of a rectangular region 11*a* and two protruding limbs 11*b*, 11*c*. Pointed holding elements 12 which in turn protrude perpendicularly are arranged in two horizontal rows on the pressing face 11*a*. Further holding elements 13 which are also pointed are arranged in vertical rows on the outer sides of the two limbs 11*b*, 11*c*. A cylindrical, ribbed pin 14, which merges, via a shoulder, with a conical pin 15 with a smaller diameter is arranged above the pressing face 11*a*. These two pins 14, 15 serve to attach a heat exchanger (not illustrated) or additional parts (not illustrated). The clamping element 10 is manufactured as a single-piece plastic injection molded part.

FIG. 2*a* shows a view from above of the second clamping element 10, wherein the circular cross sections of the pins 14, 15 can be seen. On the side the second clamping element 10 has two latching arms 16, 17 whose function will be explained below.

FIG. 2*b* shows a view from below of the second clamping element 10, wherein the triangular, pointed shape of the holding elements 12 can be seen as well as the rectangular contour of the further holding elements 13.

FIG. 2*c* shows a side view of the second clamping element 10, wherein in particular the pointed shape of the holding elements 13 can be seen. The upper part of the second clamping element 10 with the pin 14 is illustrated as a detail X in FIG. 2*d*.

FIG. 2*d* therefore shows, on the one hand, the two pins 14, 15 and underneath one of the two latching arms 16, 17, i.e. the latching arm 16. The latter is embodied as a sprung tongue and has a latching projection 18 at its free end, specifically with a hook-shaped projection 18*a* which is directed upward (in the direction of the pins 14, 15).

FIG. 3 shows the completely mounted clamping elements 1, 10 which are latched to one another. A pipe/rib block 19 with flat pipes 20 and a side part 21 (also called the lateral surface or lateral part 21) is illustrated between the two pressing faces 2, 11 by dashed lines, wherein corrugated ribs (not illustrated), which are soldered to the flat pipes to form the pipe/rib block 19, are located between the flat pipes 20 and the outermost flat pipe and the side part 21. The latching arm 16 is introduced into the holding pocket 6 from the end side 6*a* and latched with its latching projection 18 on the latching face 8 of the holding pocket 6, i.e. both clamping elements 1, 10 are clipped to one another and enclose the pipe/rib block 19 between them. The holding elements 3, 4 and 13, 12 dig into the corrugated ribs (not illustrated) between the flat pipes 20 and thus bring about positive locking between the clamping elements 1, 10 and the pipe/rib block 19 so that the entire holder cannot slip. As already mentioned, the holding elements are arranged on the pressing faces in accordance with the pipe pitch (distance of the flat pipes 20 from one another). The two uppermost holding elements 4, 13 rest here with their upper edges directly on the inside of the side part 21 of the pipe/rib block 19 and thus form an effective clamp. From the drawing it is also apparent that holding elements 4, 13 and 3, 12 which lie opposite one another penetrate the pipe/rib block 19 in each case to about half its depth.

The two holding pins 14, 15 are thus permanently connected to the pipe/rib block 19 and can therefore serve, for example, as a bearing pin, i.e. for supporting the heat exchanger, for example of a condenser for an air-conditioning system. The pins 14, 15 can however also be used to hold additional parts, for example a connecting flange for coolant connecting lines.

The two clamping elements 1, 10 can be mounted in a conceivably simple fashion: at first the first clamping element 1 is laid with its pressing face 2 against a first end face 19*a*, with the holding pockets 6 and the stop bars 5 resting against the side part 21. The first clamping element 1 is then pressed against the end face 19*a* so that the holding elements 3, 4 dig into the ribs (not illustrated). The second clamping element 10 is then moved into a corresponding position lying opposite and pressed with its pressing face 11 against the end face 19*b*, during which process the latching projection 18 is already introduced into the opening 6*a* in the holding pocket 6. During the pressing movement, the latching projection 18 slides on the ramp 7 and springs downward in the process (in the view in the drawing). At the end of the pressing movement, i.e. when the pressing face 11 has reached the end face 19*b*, the latching projection 18 snaps upward and locks itself to the latching face 8. As a result the two clamping elements 1, 10 are securely clipped to one another and cannot release themselves again but rather can only be disassembled again from the outside, for example by means of a screwdriver.

The two abovementioned clamping elements 1, 10 can also be manufactured from metal, for example by injection molding.

The invention claimed is:

1. A holder for attaching additional parts to a pipe/rib block of a heat exchanger and/or for supporting the heat exchanger, wherein the pipe/rib block comprises two end faces which are arranged parallel to one another, and lateral surfaces, wherein the holder comprises:

a clip connection of two plastic lockable clamping elements which can be latched to one another, and which are configured to hold the pipe/rib block between the two clamping elements;

wherein each clamping element comprises a pressing face which is configured to press against one of the end faces of the pipe/rib block, wherein one of the two clamping elements comprises latching arms which are configured to extend over one of the lateral surfaces, and the other of the two clamping elements comprises holding pockets which receive the latching arms, wherein each pressing face comprises a horizontal series of protruding, pointed holding elements which are configured to press into the end faces, and wherein each pressing face further comprises two protruding limbs spaced apart from each other with a vertical series of protruding, pointed holding elements.

2. The holder as claimed in claim 1, wherein the latching arms comprise tongues with latching projections.

3. The holder as claimed in claim 2, wherein the holding pockets comprise ramps for introducing the tongues and latching faces for locking the latching projections.

4. The holder as claimed in claim 1, wherein the horizontal series of protruding, pointed holding elements on each pressing face is located at a central region between their respective two protruding limbs.

5. The holder as claimed in claim 1, wherein the vertical series of protruding, pointed holding elements are each configured to be arranged at a distance from the pipes of the pipe/rib block.

6. The holder as claimed in claim 1, wherein the horizontal series of protruding, pointed holding elements are configured to be arranged in series, parallel to the pipes.

7. The holder as claimed in claim 1, wherein at least one clamping element comprises an attachment and/or support.

8. The holder as claimed in claim 7, wherein the attachment and/or support comprise holding pins.

* * * * *